United States Patent [19]

Minami et al.

[11] Patent Number: 4,560,501

[45] Date of Patent: Dec. 24, 1985

[54] APPARATUS FOR MANUFACTURING SOLIDIFIED RADIOACTIVE WASTE

[75] Inventors: Yuji Minami, Kawasaki; Hisashi Kamiyama, Yokosuka; Toshihide Tomita, Kawasaki, all of Japan

[73] Assignee: Tokyo Shibaura Denki Kabushiki Kaisha, Kanagawa, Japan

[21] Appl. No.: 525,432

[22] Filed: Aug. 22, 1983

Related U.S. Application Data

[63] Continuation of Ser. No. 206,531, Nov. 13, 1980, abandoned.

[30] Foreign Application Priority Data

Nov. 29, 1979 [JP] Japan ..... 54-153623

[51] Int. Cl.[4] ..... G21F 9/14

[52] U.S. Cl. ..... 252/628; 252/631; 422/138; 422/159; 422/903

[58] Field of Search ..... 252/628, 631, 626; 422/159, 138, 131, 135; 250/506.1

[56] References Cited

U.S. PATENT DOCUMENTS

| | | | |
|---|---|---|---|
| 3,275,809 | 9/1966 | Tolin et al. | 422/138 |
| 3,838,061 | 9/1974 | Cuaz et al. | 252/628 |
| 4,196,169 | 4/1980 | Gablin et al. | 252/628 |

OTHER PUBLICATIONS

*Encyclopedia of Polymer Science and Technology* vol. 11, Interscience Publishers, New York 1969 pp. 299–300.

*Primary Examiner*—Teddy S. Gron
*Assistant Examiner*—Howard J. Locker
*Attorney, Agent, or Firm*—Stevens, Davis, Miller & Mosher

[57] ABSTRACT

A solidified radioactive waste manufacturing apparatus comprises a first system for producing radioactive waste powder from liquid radioactive waste and a second system connected to the first system for mixing the radioactive waste powder with a thermosetting resin and additives. The first system includes a liquid radioactive waste storage tank, a dryer for drying the liquid waste into powder, and a metering device for supplying a predetermined amount of the radioactive waste powder to the second system and the second system includes a mixer connected to the metering device for mixing the waste powder with the thermosetting resin and additives, a thermosetting resin storage tank, additive storage tanks, a cooler for cooling the mixer, and a container for receiving sludged mixture from the mixer. The additive storage tanks contain a polymerization initiator, a polymerization promotor, and a polymerization retarder, respectively.

1 Claim, 1 Drawing Figure

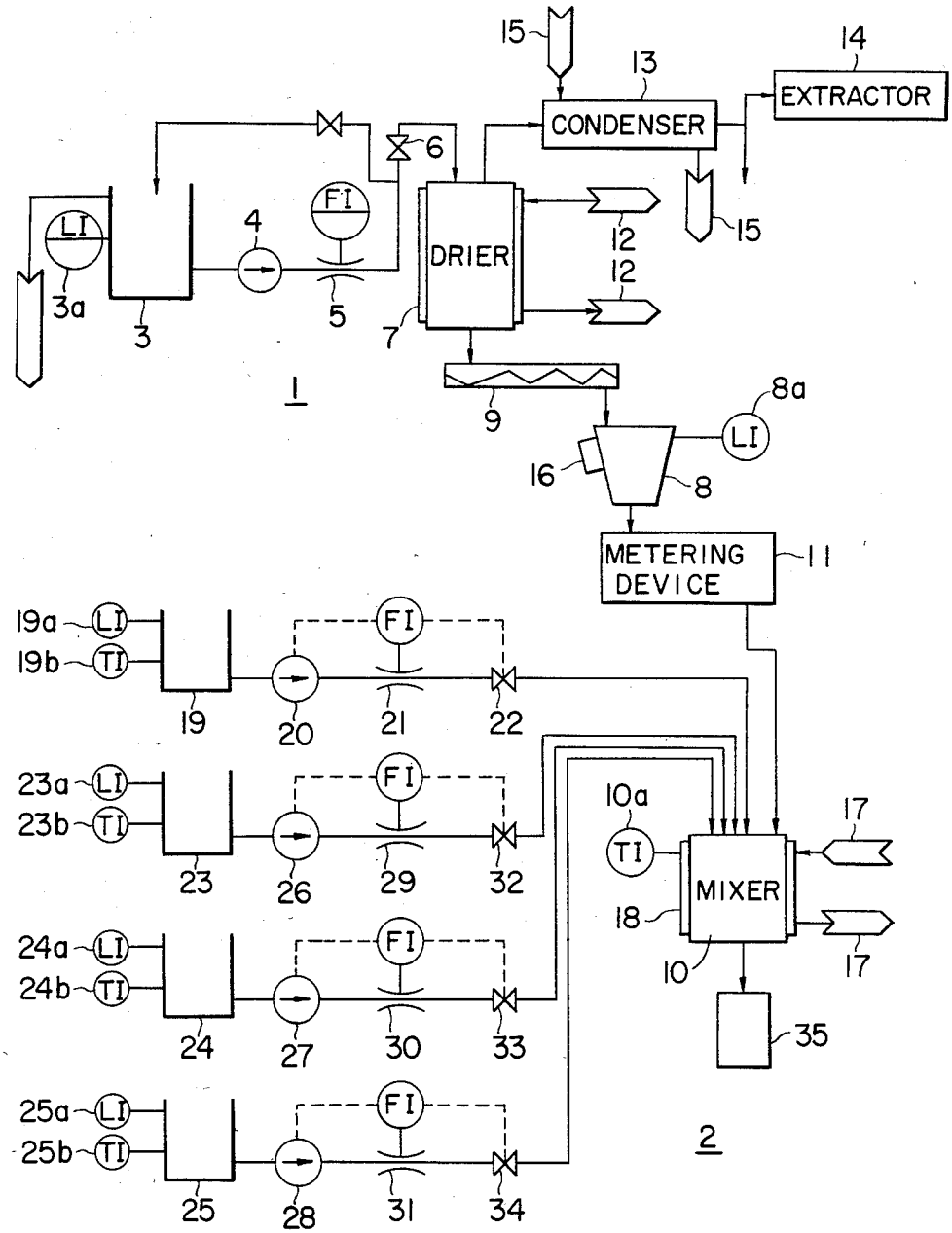
15
13
14
EXTRACTOR
CONDENSER
6
FI
LI
4
DRIER
12
12
15
3a
3
5
7
1
9
8a
LI
16
8
METERING DEVICE
11
19a
LI
19b
TI
FI
19
20
21
22
23a
LI
23b
TI
FI
10a
TI
17
23
26
29
32
MIXER
18
24a
LI
24b
TI
FI
10
17
24
27
30
33
35
25a
LI
25b
TI
FI
2
25
28
31
34

APPARATUS FOR MANUFACTURING SOLIDIFIED RADIOACTIVE WASTE

This application is a continuation, of application Ser. No. 206,531, filed Nov. 13, 1980, now abandoned.

BACKGROUND OF THE INVENTION

This invention relates to apparatus for manufacturing solidified bodies of radioactive waste produced in a nuclear power plant.

In a nuclear power plant, liquid radioactive waste is generally disposed by forming it into stably solidified bodies by mixing the radioactive waste with asphalt, cement or the like. Recently, the liquid radioactive waste is first dried to make radioactive powder and then mixed with a thermosetting resin, thereby forming solidified radioactive waste.

In the latter method, when a polymerization initiator which is operative under room temperature is used as an additive for initiating a thermosetting reaction in a mixer, the mixture of the radioactive waste powder, the thermosetting resin and the additive is set to form sludgy material which is stored in a container such as a drum can in which the mixture is solidified under the room temperature without heating, thus obtaining solidified radioactive wastes. However, during the mixing operation in the mixer, since the setting of the mixture has already been initiated because of utilization of the polymerization initiator, there is a problem regarding mixing time in the mixer. In addition, the remaining mixture adhering to the inside wall of the mixer after the main part of the mixture has been transferred into the drum can may cause a fault of the mixer or sometime may clog the outlet thereof, so that the removal and cleaning of the adhering mixture are required by using a cleaning agent. Thus, it is also required to deal with the used cleaning agent to remove the radioactive mixture contained therein.

SUMMARY OF THE INVENTION

It is an object of this invention to obviate aforementioned defects of the prior art and to provide an improved apparatus for manufacturing solidified radioactive waste.

According to this invention, there is provided apparatus for manufacturing solidified radioactive waste comprising a first system for producing radioactive waste powder from liquid radioactive waste and a second system connected to the first system for mixing the radioactive waste powder with a thermosetting resin and additives, and the apparatus is characterized in that the first system includes a liquid radioactive storage tank, a dryer connected to the liquid radioactive waste storage tank for drying the liquid radioactive waste into powder, and a metering device for supplying a predetermined amount of the radioactive waste powder to the second system, and the second system includes a mixer connected to the first system for mixing the radioactive waste powder with a thermosetting resin and additives, a thermosetting resin storage tank connected to the mixer, additive storage tanks respectively containing a polymerization initiator and a polymerization promotor and connected to the mixer, a device for cooling the mixer, and a container for receiving sludged mixture from the mixer.

BRIEF DESCRIPTION OF THE DRAWING

In the accompanying drawing, a single FIGURE shows a block diagram of the apparatus for manufacturing solidified radioactive waste according to this invention.

DESCRIPTION OF THE PREFERRED EMBODIMENT

As shown in the accompanying drawing, the solidified radioactive waste manufacturing apparatus according to this invention comprises a radioactive powder producing system 1 in which liquid radioactive waste is formed into a radioactive waste powder and a mixing system 2 which is operatively connected to the system 1 and in which the radioactive waste powder is mixed with a thermosetting resin and additives.

The system 1 comprises a liquid radioactive waste storage tank 3 and a dryer 7 connected to the tank 3 through a pump 4, a flow meter 5 and a valve 6 and adapted to dry the liquid radioactive waste into radioactive powder. The system 1 further comprises a powder conveyer 9, a powder storage tank 8 connected to the conveyer 9, and a metering device 11 for supplying a predetermined amount of the powder in the tank 8 into a mixer 10 of the mixing system 2. The dryer 7 is heated by a heat transfer medium 12, for example steam, to dry the liquid radioactive waste and the steam contained in the gas exhausted from the dryer 7 is condensed by a condenser 13 which is cooled by cooling liquid 15. Non-condensable gas in the exhausst gas is extracted by an extractor 14. A device 16 for vibrating the powder storage tank 8 is attached to the outside surface thereof so that the powder does not clog the outlet of the tank 8 and the amount of the powder in the tank 8 is indicated by a level indicator **8*a*** attached thereto.

The mixer 10 of the mixing system 2 is provided with a cooling jacket 18 through which cooling liquid 17 such as antifreezing solution passes. Into the mixer 10 is supplied a thermosetting resin from a thermosetting resin storage tank 19 by the operation if a pump 20 through a flow indicator 21 and a valve 22. In addition, additives such as polymerization initiator, promotor and retarder are properly added by predetermined amounts into the mixer 10 from an initiator storage tank 23, promotor storage tank 24, and retarder storage tank 25 through respective flow indicators 29, 30, and 31 and valves 32, 33, and 34 by the operations of corresponding pumps 26, 27, and 28.

To the respective storage tanks and the mixer are attached level indicators **3*a*, 10*a*, 19*a*, 23*a*, 24*a*, and 25*a* and temperature indicators 19*b*, 23*b*, 24*b*, and 25*b***.

The liquid radioactive waste guided into the system 1 of the apparatus of this invention is first stored in the tank 3 and then fed into the dryer 7 in which the liquid waste is dried to produce powdered radioactive waste. Although the powdered waste conveyed into the tank 8 by the conveyer 9 is then fed successively into the mixer 10 if a predetermined amount of powder has been previously stored in the tank 8, the waste powder can be supplied independently from the operation of the dryer 7. A predetermined amount of the radioactive waste powder can be fed from the tank 8 to the mixer 10 by interposing the metering device 11 therebetween. The radioactive waste powder is mixed with the thermosetting resin and the polymerization initiator and promotor in the mixer 10, thus providing sludge-formed mixture which is then discharged into the drum can 35. The polymerization retarder may be added in accordance with the operation condition of the apparatus. Thus, the sludgeformed radioactive waste is not scattered and environmental contamination due to the radioactive waste powder can be prevented by installing only the powder producing system 1 in a sealed structure.

Moreover, according to this invention, the mixer 10 is provided with the cooling jacket 18 through which cooling medium 17 passes so as to delay a time necessary for setting a mixture adhering to the inside wall of the mixer. For example, as shown in the following Table 1, except for a case H, the mixture is set over one day under −20° C. in the mixer, so that in a case where the apparatus is operated every day, the mixture adhering to the wall is again mixed with newly supplied waste powder, thermosetting resin and additives and discharged before it has been set.

TABLE 1

| | Concentration (%) of Polymerization Initiator | Concentration (ppm) of Polymerization Retarder | Thermosetting Time (under room temperature) | Thermosetting Time (under −20° C.) |
|---|---|---|---|---|
| A | 0.5 | 500 | One week | More than one week |
| B | 0.5 | 300 | Two days | More than one week |
| C | 0.5 | 100 | One day | More than one week |
| D | 0.5 | 0 | Several hours | One day |
| E | 1.0 | 500 | Two days | More than one week |
| F | 1.0 | 300 | One day | More than one week |
| G | 1.0 | 100 | One day | More than one week |
| H | 1.0 | 0 | Several hours | Half a day |

Moreover, in cases where a proper amount of the polymerization retarder is added into the mixer, a time necessary for setting the mixture can be elongated to about one week or more, so that it is not necessary to clean the inside wall of the mixer to remove the adhering mixture if the operation of the apparatus is stopped at week end except for a long-time stoppage of the operation thereof.

In a case D or H in which the polymerization retarder is not added into the mixer, the mixture sets over several hours under the room temperature and over one half day through one day under a temperature of −20° C.

Actual examples carried out by using the apparatus according to this invention are shown in the following Table 2 in which radioactive wastes such as an $Na_2SO_4$ solution and a slurry containing an ion-exchange resin are dried and solidified.

TABLE 2

| Radioactive waste | Condition after drying | Mixed ratio with respect to thermosetting resin | Specific gravity of solidified waste | Compression strength of solidified waste |
|---|---|---|---|---|
| $Na_2SO_4$ solution | Powder with water content of less 1% | 63/37 | 1.75 | More than 600 kg/cm$^2$ |
| Slurry containing ion-exchange resin | Powder with water content of less 1% | 50/50 | 1.25 | More than 600 kg/cm$^2$ |

According to "Compression Strength of Solidified Waste" in Table 2, it will be understood that stably solidified waste materials can be obtained by using the apparatus according to this invention.

According to this invention, the powder storage tank 8 may be eliminated by directly connecting the systems 1 and 2, and any other modification or change may be possible within the scope of this invention.

What is claimed is:

1. In an apparatus for manufacturing solidified radioactive waste of the type comprising a first system including a drier for producing radioactive waste powder from liquid radioactive waste and a second system includng a mixer for mixing said radioactive waste powder with a thermosetting resin and additives and tanks connected to said mixer for storing said thermosetting resin and said additives, the improvement comprising a radioactive waste powder storage tank connected between said drier and said mixer for storing said radioactive waste powder, a metering device connected between said powder storage tank and said mixer for supplying a predetermined amount of said radioactive waste powder to said mixer, cooling means attached to said mixer for cooling said mixer, said cooling means being designed and sized to maintain the mixture in said mixer at a temperature of about −20° C. so as to delya setting of those portions of the mixture adhering to the inside wall of said mixer, so that the portions of the mixture adhering to the inside wall may be mixed with a subsequent batch of mixture and said mixture adhering to the inside wall does not have to be cleaned from said mixer, and a container for receiving the mixture from said mixer.

* * * * *